US007639228B2

(12) United States Patent
Nagata

(10) Patent No.: US 7,639,228 B2
(45) Date of Patent: Dec. 29, 2009

(54) LIQUID CRYSTAL DISPLAY DEVICE

(75) Inventor: Mitsutoshi Nagata, Obu (JP)

(73) Assignee: DENSO CORPORATION, Kariya (JP)

( * ) Notice: Subject to any disclaimer, the term of this patent is extended or adjusted under 35 U.S.C. 154(b) by 662 days.

(21) Appl. No.: 11/322,656

(22) Filed: Jan. 3, 2006

(65) Prior Publication Data

US 2006/0146002 A1 Jul. 6, 2006

(30) Foreign Application Priority Data

Jan. 6, 2005 (JP) ..... 2005-001914

(51) Int. Cl.
*G09G 3/36* (2006.01)

(52) U.S. Cl. ..... 345/101; 345/102; 345/27

(58) Field of Classification Search ..... 345/102, 345/27

See application file for complete search history.

(56) References Cited

U.S. PATENT DOCUMENTS

| | | | | |
|---|---|---|---|---|
| 4,168,510 | A * | 9/1979 | Kaiser | 348/579 |
| 4,179,704 | A * | 12/1979 | Moore et al. | 348/579 |
| 4,214,263 | A * | 7/1980 | Kaiser | 348/579 |
| 4,233,631 | A * | 11/1980 | Mahler | 348/579 |
| 5,010,407 | A * | 4/1991 | Trytko | 348/579 |
| 5,844,534 | A * | 12/1998 | Okumura et al. | 345/90 |
| 6,133,946 | A * | 10/2000 | Cavallaro et al. | 348/135 |
| 6,496,177 | B1 * | 12/2002 | Burton | 345/101 |
| 6,727,824 | B1 * | 4/2004 | Miseli et al. | 340/689 |
| 6,762,743 | B2 * | 7/2004 | Yoshihara et al. | 345/102 |
| 7,034,788 | B2 * | 4/2006 | Someya et al. | 345/89 |
| 7,248,242 | B2 * | 7/2007 | Chen et al. | 345/89 |
| 7,420,538 | B2 * | 9/2008 | Murao et al. | 345/101 |
| 2003/0098839 | A1 * | 5/2003 | Lee | 345/89 |
| 2003/0107546 | A1 * | 6/2003 | Ham | 345/101 |

(Continued)

FOREIGN PATENT DOCUMENTS

| | | |
|---|---|---|
| JP | A-56-42480 | 4/1981 |

(Continued)

OTHER PUBLICATIONS

Office Action dated Apr. 4, 2008 in corresponding Chinese Patent Application No. 2006100057857 (and English translation).

(Continued)

*Primary Examiner*—Richard Hjerpe
*Assistant Examiner*—Gregory J Tryder
(74) *Attorney, Agent, or Firm*—Posz Law Group, PLC

(57) ABSTRACT

A moving image portion that indicates a moving object moving not less than a given movement amount and a still image portion other than the moving image portion are distinguished with respect to a video signal. Video display data for displaying the moving image portion is generated by repeatedly using the same video signal by repetition times based on temperature of a liquid crystal panel. Movement display data for displaying movement positions of the moving image portion is then generated based on a video signal obtained after the video signal used for displaying the moving image portion and is combined with the video display data. This achieves an effect similar to that obtained by decreasing a field frequency and decreases a "tail trail" phenomenon of the moving object. Furthermore, the movement display data enables recognition of the almost actual position of the moving object.

10 Claims, 4 Drawing Sheets

U.S. PATENT DOCUMENTS

| | | | | |
|---|---|---|---|---|
| 2004/0135800 | A1 * | 7/2004 | Shiomi et al. | 345/691 |
| 2005/0062712 | A1 | 3/2005 | Noda | |
| 2005/0078081 | A1 * | 4/2005 | Oda et al. | 345/102 |

FOREIGN PATENT DOCUMENTS

| | | |
|---|---|---|
| JP | A-3-87679 | 4/1991 |
| JP | A-7-223487 | 8/1995 |
| JP | A-2002-279560 | 9/2002 |
| JP | A-2002-365611 | 12/2002 |

OTHER PUBLICATIONS

First Office Action dated Jul. 27, 2007 in corresponding Chinese patent application No. 2006100057857 (and English translation).

* cited by examiner

LIQUID CRYSTAL DISPLAY DEVICE

CROSS REFERENCE TO RELATED APPLICATIONS

This application is based on and incorporates herein by reference Japanese Patent Application No. 2005-1914 filed on Jan. 6, 2005.

FIELD OF THE INVENTION

The present invention relates to a liquid crystal display device.

BACKGROUND OF THE INVENTION

In a liquid crystal panel, viscosity of liquid increases at low temperatures. A response time period from when voltage is applied to liquid crystal molecules to when the liquid crystal molecules start moving becomes long at low temperatures. Consequently, when a moving image is displayed on a liquid crystal panel at low temperatures, as shown in FIGS. 6A, 6B, a moving object (A0, B0) is shown to trail (a so-called "tail trail" phenomenon takes place along a moving object image (AW, BW)).

Patent Document 1 proposes a liquid crystal display device that changes a switching frequency of a video signal and backlight for displaying video based on temperature of the liquid crystal panel. This liquid crystal display device is a field-sequential type. When the temperature detected by a temperature sensor decreases less than a reference temperature, the liquid crystal display device increases a time interval (or cycle) for reading out a video signal of red, green, and blue for one screen picture (or one field) written on V-RAM. Namely, a frequency (field frequency) for reading out video signals is changed to decrease and then the readout video signals are sequentially applied to X and Y electrodes of the liquid crystal panel. Time intervals for lighting up light-emitting diodes of red, green, and blue are synchronously changed. Thus, quality of the video on the liquid crystal display device at low temperatures is maintained.

Patent Document 1: JP-2002-365611 A

In the above liquid crystal panel, as explained, the field frequency for reading out video signals and the frequency for lighting up the backlight are decreased when the temperature of the liquid crystal panel decreases. Therefore, when a video signal is for displaying the moving object, it may become difficult to continuously display positional variation of the moving object in almost real time. This poses a problem that there is a significant difference between an actual position and a displayed position of the moving object on the liquid crystal panel.

SUMMARY OF THE INVENTION

It is an object of the present invention to provide a liquid crystal display device to decrease the above-described "tail trail" phenomenon and enable recognition of an almost actual position of a moving object.

To achieve the above object, a liquid crystal display device is provided with the following: In the liquid crystal display device, a video signal that changes on a basis of time is obtained with a given cycle and video is displayed based on the obtained video signal. The liquid crystal display device includes: a displaying unit including a liquid crystal panel; a storing unit for storing the video signal; a temperature detecting unit for detecting a temperature of the displaying unit; a determining unit for distinguishing, with respect to the video signal, between (i) a moving image portion indicating a moving object that moves not less than a given movement amount and (ii) a still image portion other than the moving image portion; a repetition times setting unit for setting, based on the detected temperature of the displaying unit, repetition times that a same video signal is repeatedly used with respect to at least the moving image portion; and a generating unit for generating, with respect to at least the moving image portion, video display data to be outputted to the displaying unit with the given cycle by repeatedly using the same video signal by the set repetition times. Here, the generating unit generates movement display data that indicates a movement position of the moving image portion based on a video signal obtained after a video signal used for displaying the moving image portion was obtained, and generates video display data with which the generated movement display data is combined.

Under this structure of the present invention, when the temperature of the liquid crystal panel decreases less than a reference temperature (e.g., less than zero degree centigrade), video display data is generated for displaying the moving image portion by repeatedly using the same video signal by the set repetition times. This achieves an effect similar to that obtained when a field frequency decreases, thereby decreasing the "tail trail" phenomenon of the moving object.

Furthermore, the movement display data for indicating movement positions of the moving image portion is combined with the video display data. This movement display data does not show the moving image portion itself but shows a symbol indicating only a movement position of the moving object. Therefore, the "tail trail" phenomenon is not involved by the movement display data; thereby, the almost actual position of the moving object can be recognizably displayed.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

A liquid crystal display device according to an embodiment will be explained with reference to figures. The device is, for instance, applicable to a case where a camera shoots video surrounding a vehicle, e.g., forward, sideward, or rearward of a vehicle, and the video shot by the camera is displayed inside the vehicle. If this vehicle is located in a cold district whose outdoor temperature is below the freezing temperature, the response of the liquid crystal is slow and the "tail trail" phenomenon may thereby take place.

Figure 1:
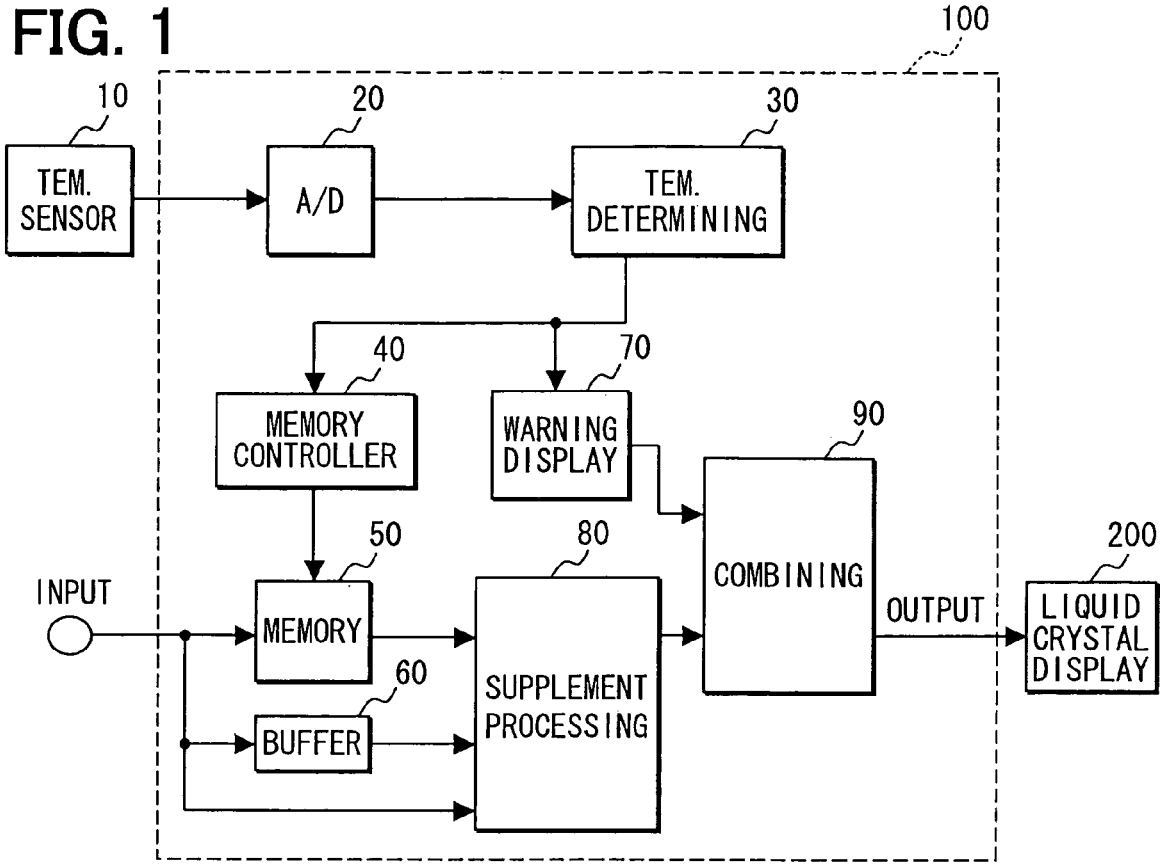
FIG. 1 is a structural block diagram of a liquid crystal display device according to an embodiment of the present invention.

As shown in FIG. 1, the liquid crystal display device includes a liquid crystal monitor 200 as a displaying unit, a temperature sensor 10 as a temperature detecting unit such as a thermistor for detecting temperatures, and a control unit 100.

The temperature sensor 10 is, for instance, arranged in the front surface of a liquid crystal panel (or LCD panel) to continuously output analog signals corresponding to temperatures of the liquid crystal panel. The analog signals are inputted to the control unit 100.

The control unit 100 includes an A/D converter unit 20, a temperature determining unit 30, a memory controller unit 40, a memory unit 50, a buffer 60, a warning display unit 70, a supplement processing unit 80, and a combining unit 90. The control unit 100 conducts the following: obtaining a video signal for displaying video, from outside (e.g., camera) with a given cycle (or interval) to store it in the memory unit 50 and the buffer 60; generating video display data of one screen picture (one field) based on the stored video signal; and outputting the generated video display data to the liquid crystal monitor 200 with the given cycle. The generating method for the video display data by the control unit 100 will be explained later in detail.

The liquid crystal monitor 200 includes a TFT-LCD (Thin Film Transistor Liquid Crystal Display) of a non-light-emitting type display, a backlight, and an optical waveguide plate. The TFT-LCD includes a liquid crystal panel (or LCD panel), a TFT, and a color filter. The liquid crystal panel has a structure where filamentous liquid crystal molecules are arranged in one direction between two glass base plates forming transparent electrodes and light distribution films. The TFT functions as a switching unit to change the arrangement of the filamentous liquid crystal molecules by applying voltage.

Figure 3:
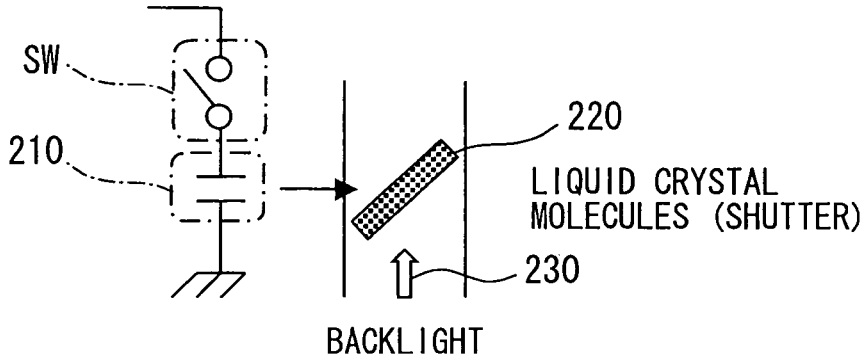
FIG. 3 is an equivalent circuit of one color in one pixel in a liquid crystal panel using an active element switch.

An operation principle of the liquid crystal panel will be explained with reference to FIGS. 3, 4A, 4B. FIG. 3 shows an equivalent circuit of one color in one pixel in the liquid crystal panel using an active element switch SW such as a TFT. When the active element switch SW is closed, a given amount of electrical charge is accumulated in a capacitor 210. Thus accumulated electrical charge amount (i.e., voltage) controls a transmission amount (or transmission ratio of pixels) that the liquid crystal molecules 220 transmit the backlight 230 led by the optical waveguide plate (not shown). This control of the transmission ratio enables gradation control of brightness. Thus, brightness of each active element switch SW corresponding to each color of RGB of the color film is controlled, so a given color is displayed in each pixel. After the given amount of electrical charge is accumulated, each active element switch SW is opened and the voltage is held till the subsequent filed.

As explained above, the liquid crystal functions as a shutter to control the transmission amount of the backlight 230 and states of the shutter change every given cycle corresponding to the field frequency. As known, the liquid crystals have sufficient capability of displaying moving images at room temperature, but tend to display "tail trail" images because the response of the liquid crystal molecules worsens, for instance, at less than zero degree centigrade.

Figure 4A:
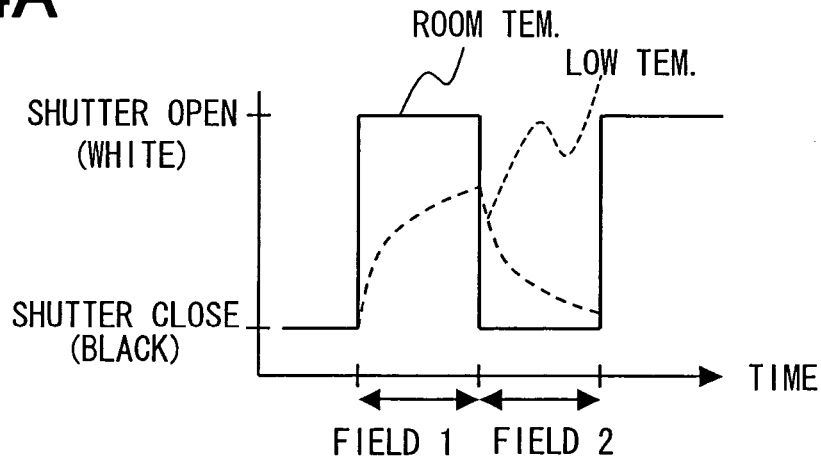
FIG. 4A is a schematic diagram showing state transition of a shutter at room temperature and at a low temperature.
Figure 4B:
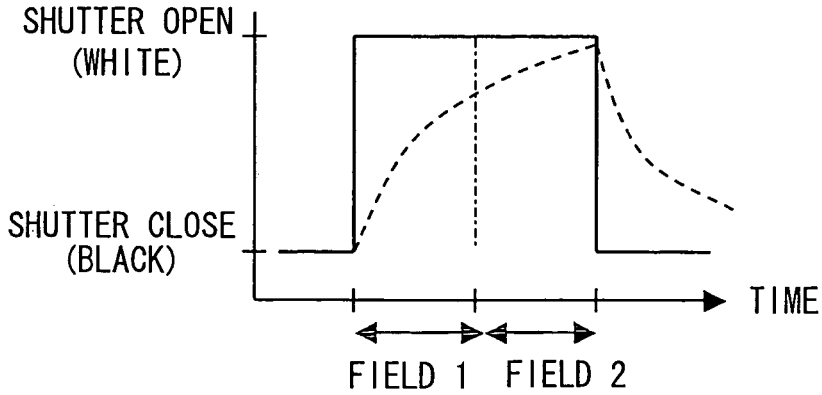
FIG. 4B is a schematic diagram showing state transition of a shutter generated when the same video signal is repeatedly used for displaying without changing a field frequency.

FIG. 4A shows shutter state transition in fields with respect to a TN liquid crystal being normally white (having a property of displaying white without voltage applied). Here, solid lines show shutter state transition at room temperature; therefore, a target shutter state can be achieved at the initial stage of each field. In contrast, dotted lines show shutter state transition at a low temperature; thereby, a target shutter state cannot be achieved within each field. For instance, in FIELD 2, although the shutter close (black) is targeted, the backlight is leaked with the shutter not entirely closed. This poses a problem of presence of the "tail trail" phenomenon.

To solve this problem, the liquid crystal display device according to the embodiment conducts the following: distinguishing between (i) a moving image portion that indicates a moving object moving not less than a given movement amount and (ii) a still image portion other than the moving image portion, with respect to video signals cyclically obtained; determining that temperature of the liquid crystal panel decreases less than a reference temperature (e.g., zero degree centigrade); and then, at least with respect to moving image portion, generating the above-described video display data by repeatedly using the same video image. As a result, as shown in FIG. 4B, where a video signal in FIELD 2 is the same as that in FIELD 1, the same effect as that obtained when a field frequency is decreased is obtained although the field frequency is constant. This helps prevent "tail trail" due to the display of the moving object from occurring.

Next, the generation of the video display data of the control unit 100 will be explained regarding a structure and method with respect to FIGS. 1, 2.

At first, in the control unit 100, the A/D converter unit 20 converts an analog signal indicating temperature of the liquid crystal panel outputted from the temperature sensor unit 10 to a digital signal to output it to the temperature determining unit 30. The temperature determining unit 30 receiving the outputted digital signal determines whether the liquid crystal panel temperature decreases less than the reference temperature. When determining the temperature decrease, the temperature determining unit 30 determines repetition times (or the number of repetitions) Y for repeatedly using the same video signal to output it to the memory controller unit 40 and the warning display unit 70.

Here, a relationship between the liquid crystal panel temperature T and the repetition times Y is specified with FORMULA 1 as follows:

$$Y=0.015\times T^2 \text{ at } T<0$$

$$Y=0 \text{ at } T\geqq 0 \qquad \text{FORMULA 1}$$

Here, variation of the response time of the liquid crystal based on temperatures is differentiated by types of liquid crystal panels, so it is preferable that each liquid crystal panel is assigned a coefficient (e.g., 0.015). Furthermore, the repetition times Y can be obtained without using FORMULA 1; for instance, a map indicating a relationship between T and Y is previously stored, and Y is read out from this map. While the same video signal is repeatedly used to display the moving image portion, a video signal newly obtained is not used for displaying moving image portion.

The memory controller 40 receiving the repetition times Y from the temperature determining unit 30 indicates to the memory unit 50 an address where a video signal to be outputted is stored in order to cause the memory unit 50 to output the same video signal by the repetition times Y.

The memory unit 50 has a capacity to store as many as the maximum of the repetition times Y indicated by the memory controller unit 40 and stores a new video signal by changing an address indicating a storing area each time the new video signal is newly received. When the memory unit 50 has already stored video signals corresponding to the maximum of the repetition times Y, the oldest video signal is erased and the newest video signal is written over it to be stored.

It can be alternatively designed that the memory unit 50 stores only a video signal inputted just after the repetition times Y indicated by the memory controller unit 40 has passed. It is because video signals inputted while the same video signal is repeatedly used are not used for displaying the moving image. This can reduce a required storing capacity of the memory unit 50.

The buffer 60 can store video signals corresponding to two screen pictures. That is, while storing a newest video signal obtained most recently, the buffer 60 outputs a video signal obtained one given cycle before the newest video signal, to the supplement processing unit 80. If the memory unit 50 can store the video signal obtained one given cycle before the newest video signal, the buffer 60 can be removed.

The warning display unit 70 outputs to the combining unit 90 a warning that the moving image portion in the video display data is repeatedly using the same video signal when receiving the repetition times Y from the temperature determining unit 30. This causes a user to recognize that the display position of a moving object is updated every several video signals and the moving object is being displayed like a stop motion. This warning can be notified using sound or the like other than the liquid crystal panel.

The supplement processing unit 80 receives three video signals A, B, C from the memory unit 50, the buffer 60, and the newest video signal. The video signal A is used for displaying the moving image portion; the video signal B is obtained one given cycle before the video signal C; and the video signal C is the newest video signal obtained most recently. The supplement processing unit 80 then selects an image or a video signal used for generating the above-described video display data with respect to each pixel and outputs it to the combining unit 90.

The combining unit 90 collects pixel data outputted from the supplement processing unit 80 to generate one screen picture, combines the generated one screen picture to overlap with the warning message outputted from the warning display unit 70, and outputs the combined picture to the liquid crystal monitor 100.

Next, the supplement processing 80 and the combining unit 90 will be explained with reference to FIG. 2 that shows a structure of the supplement processing unit 80 in detail. The above video signals A, B, C are inputted, with respect to each pixel at the same position, to the supplement processing unit 80. Each of the video signals A, B, C with respect to each pixel includes a brightness signal and a color signal. When the video signals B, C are used for distinguishing between a moving image portion and a still image portion, the brightness signal of each pixel is only used.

Figure 2:
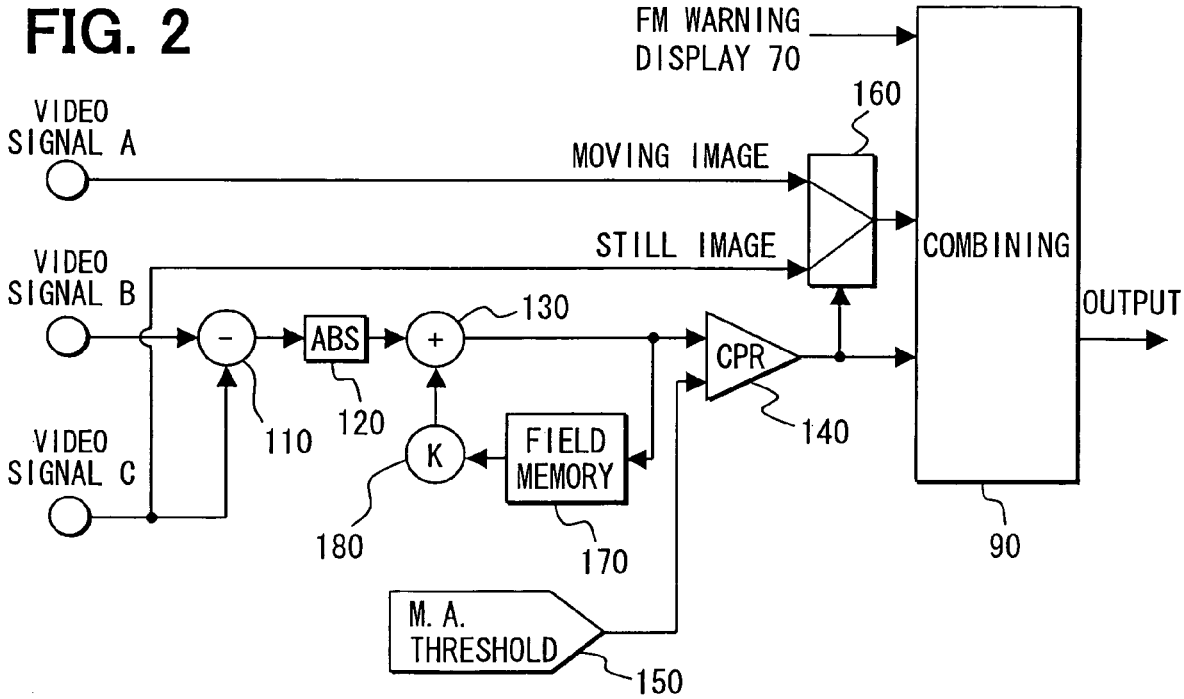
FIG. 2 is a structural block diagram of a supplement processing unit.

In FIG. 2, a subtraction unit 110 receives a brightness signal of each pixel of the newest video signal C and a brightness signal of each pixel of the video signal B one given cycle before the newest video signal B, and computes a brightness difference between them. The brightness difference computed by the subtraction unit 110 is outputted to an absolute value computation unit 120 to compute an absolute value of the brightness difference.

The absolute value of the brightness difference computed by the absolute value computation unit 120 is outputted to an addition unit 130. In contrast, a field memory 170 stores the absolute values of the brightness difference previously outputted from the addition unit 130 with respect to each pixel. The field memory 170 further outputs the absolute values of brightness difference stored with respect to each pixel corresponding to each pixel of the inputted video signals B, C. A multiplication unit 180 outputs to the addition unit 130 an attenuated brightness difference obtained by multiplying the absolute value of brightness difference outputted from the field memory 170 by a given attenuation coefficient K.

The addition unit 130 adds the brightness difference outputted from the absolute value computation unit 120 to the attenuated brightness difference outputted from the multiplication unit 180 to output an added brightness difference to a comparison unit 140.

The comparison unit 140 receives the added brightness difference from the addition unit 130 and a movement amount threshold value from a movement amount threshold value output unit 150 to output a moving image determining signal when the added brightness difference is not less than the movement amount threshold value. Here, the movement amount threshold value is differentiated based on response time of a liquid crystal, so the movement amount threshold value is experimentally obtained with respect to each liquid crystal panel type while observing video displayed on the liquid crystal panel.

In video signals continuously obtained, (i) a brightness difference of each pixel and (ii) a movement amount of a moving object have correlation therebetween. Therefore, it can be determined using the brightness difference whether the relevant pixel is included in a moving image portion or in a still image portion. That is, the comparison unit 140 distinguishes between a moving image portion and a still image portion based on the brightness difference of each pixel.

The moving image determination signal from the comparison unit 140 is inputted to a selection unit 160 and the combining unit 90. The selection unit 160 selects to output a pixel of the video signal A for displaying a moving object when the moving image determination signal is inputted from the comparison unit 140, whereas selecting to output a pixel of the newest video signal C for displaying a still image when no moving image determination signal is inputted.

Thus, the comparison unit 140 conducts a moving image determination using the movement amount threshold value (e.g., value corresponding to a movement of two pixels per one field) to be able to determine as a still image portion an image portion that has a movement amount less than the movement amount threshold value and does not completely stop. When a certain image is determined to be as a still image portion, the newest video signal C corresponding to the certain image is used for generating video display data. The resultant display can be thereby conducted in almost real time. Furthermore, in this case, a slight "tail trail" may occur and the display of the image may blur. However, this still image portion can be noticeable by re-setting the movement amount threshold value in consideration of the response time of the liquid crystal panel.

Figure 5B:
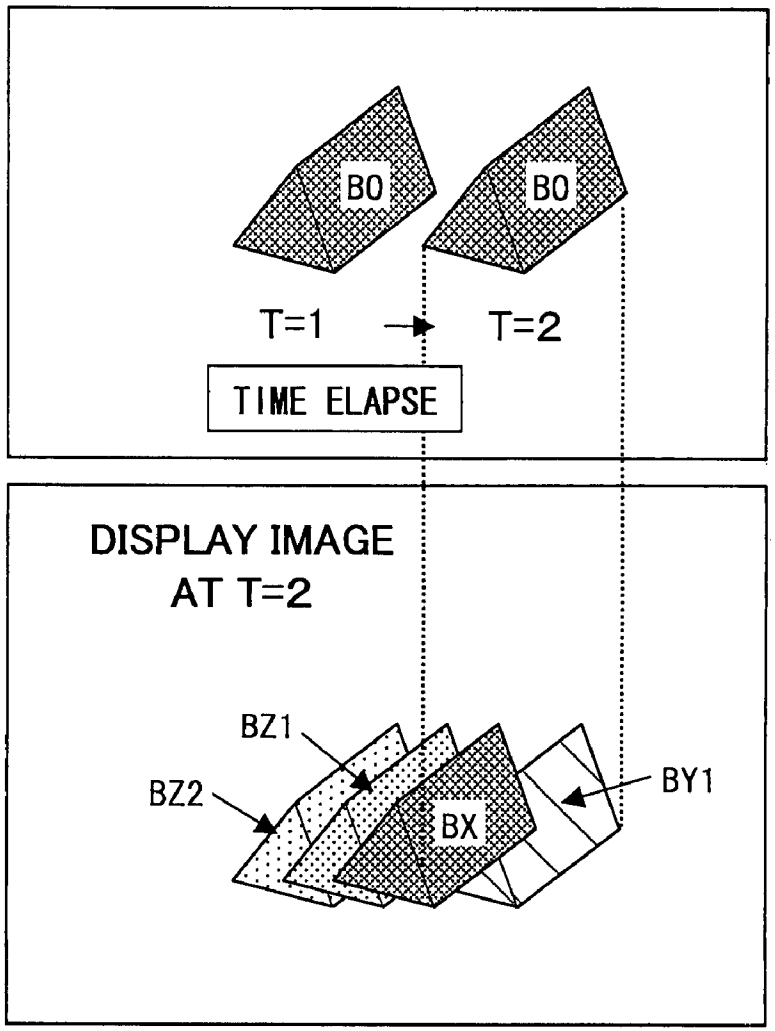
FIG. 5A, 5B are a view showing movement of a moving object and a corresponding schematic display image on a liquid crystal panel according to an embodiment of the present invention.
Figure 5A:
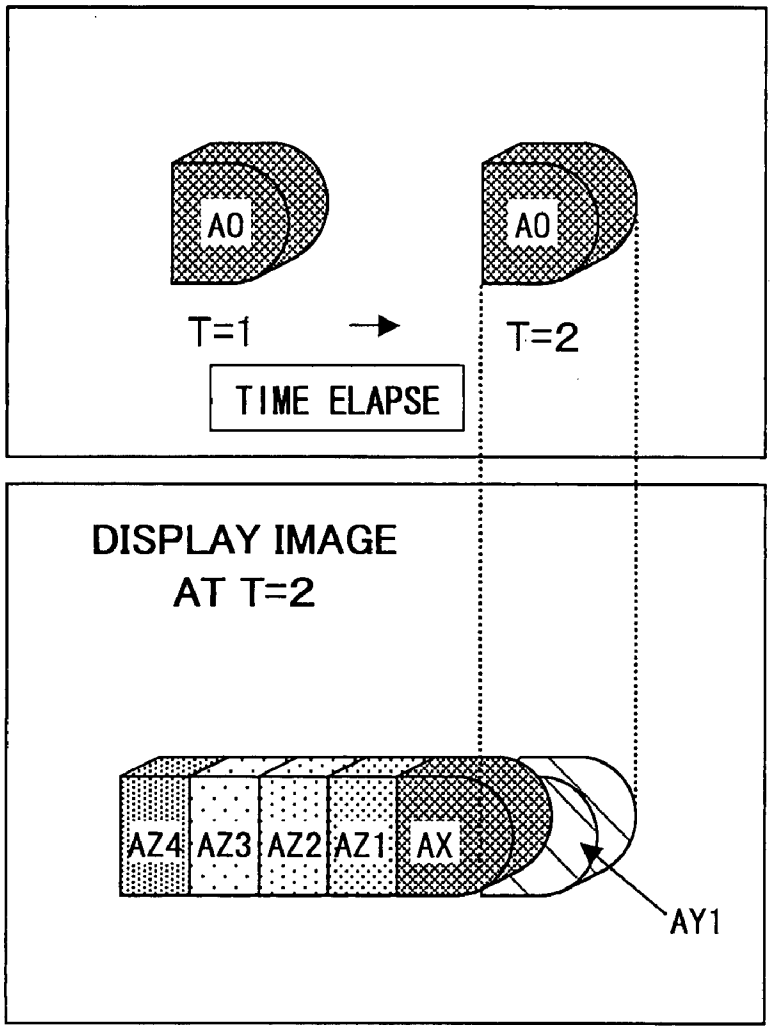

The combining unit 90 generates video display data by combining the pixels outputted from the selection unit 160, and further combines, with the video display data, movement display data indicating a movement position of a moving object based on the moving image determination signal from the comparison unit 140. The movement display data will be explained below in detail with reference to FIGS. 5A, 5B.

Figure 6B:
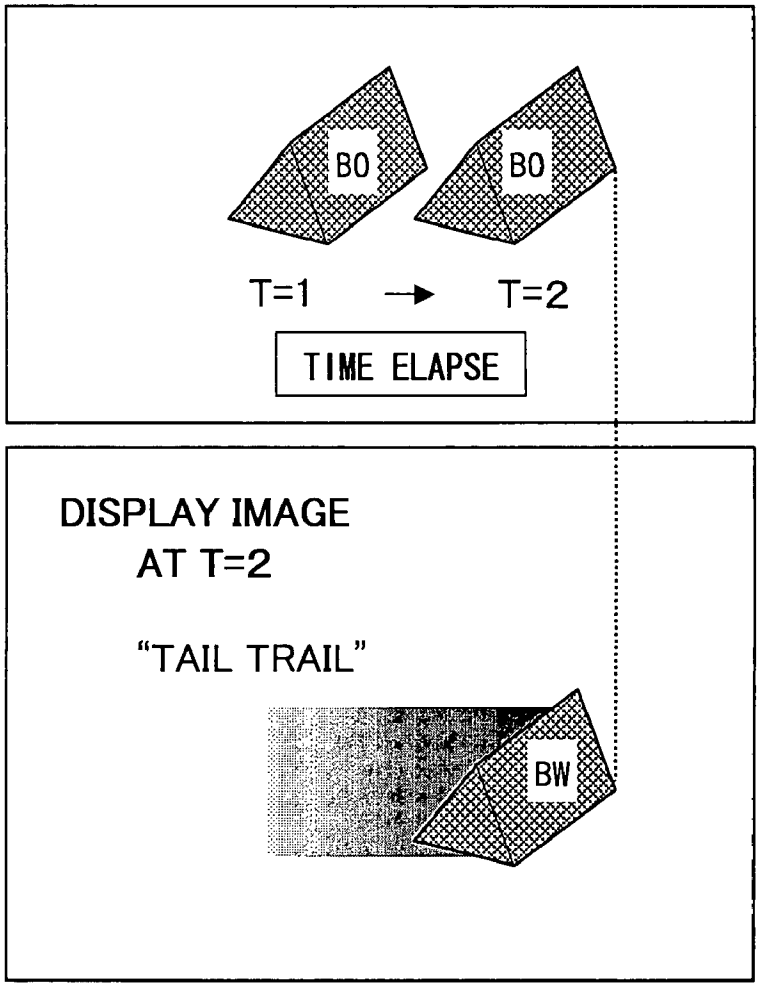
FIG. 6B PRIOR ART
FIG. 6A, 6B are a view showing movement of a moving object and a corresponding schematic display image on a liquid crystal panel in a prior art.
Figure 6A:
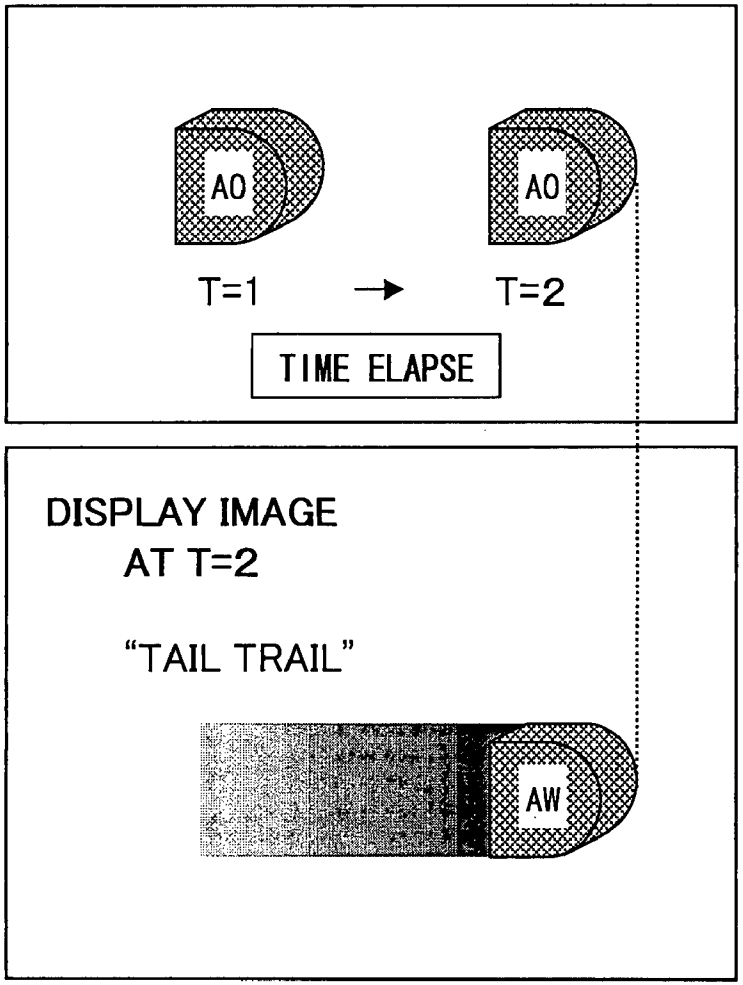
FIG. 6A PRIOR ART

As explained above, in this embodiment, to help prevent a "tail trail" phenomenon at a low temperature (shown in FIGS. 6A, 6B), video display data with respect to a moving image portion determined to be a moving image of a moving object (A0, B0 in FIGS. 5A, 5B) is generated by repeatedly using pixels of the video signal A previously obtained. This may pose a problem that a difference is found between the actual moving object position (A0, B0 at T=2 in FIGS. 5A, 5B) and the displayed moving object position (AX, BX in FIGS. 5A, 5B) on the liquid crystal panel. To deal with this problem, movement display data (AY1, BY1 in FIGS. 5A, 5B) indicating a movement position of the relevant moving image portion is generated based on the video signals B, C that are more recently obtained than the video signal A used for displaying the moving image portion is obtained. This movement display data is then combined with the video display data.

In detail, when the comparison unit 140 outputs the moving image determination, movement display data (AY1, BY1 in FIGS. 5A, 5B) is generated by altering a color signal of each pixel determined to be a moving image to a color signal specific to display for the movement position of the relevant moving object. This enables the specific color to indicate the actual moving object position (AY1, BY1 in FIGS. 5A, 5B) determined from the newest video signal C and the video signal B one given cycle before the newest video signal C.

Furthermore, the brightness difference between each pixel of the newest video signal C and that of the video signal one given cycle before the newest video signal C is added to the attenuated brightness difference computed based on the brightness differences generated in the past. Therefore, while a moving image determination is conducted by the brightness difference between the each pixel of the newest video signal C and that of the video signal one given cycle before the newest video signal C, another moving image determination is also conducted by the brightness difference generated in the past. As a result, not only the newest movement position (AY1, BY1 in FIGS. 5A, 5B) of the moving object but also previous movement positions (i.e., a movement path of the moving object) (AZ1 to AZ4, BZ1 to BZ2 in FIGS. 5A, 5B) before reaching the displayed moving image (AX, BX in FIGS. 5A, 5B) and the newest movement position (AY1, BY1 in FIGS. 5A, 5B) can be displayed by using the above specific color.

Here, the brightness differences generated in the past is multiplied by the attenuation coefficient. Therefore, the moving image determination is not outputted after several computations; the display by the specific color thereby ends.

As explained above, in this embodiment, the movement display data with the specific color indicating the movement position of the moving image portion is combined with the video display data. This movement display data is not for displaying the moving object itself but for indicating the movement position alone of the moving object as an indicating symbol. Consequently, this movement display data enables recognition of the almost actual moving object position without causing the "tail trail" phenomenon.

(Modification)

The above embodiment can be modified without any limitation as long as the features of the present invention are maintained.

For instance, in the above embodiment, a color signal of a pixel is determined to be a moving image based on the brightness difference of each pixel of the newest video signal C and the video signal B one given cycle before the newest video signal C. Then, this color signal is changed to a specific color. However, when the video signal A repeatedly used for displaying the moving image portion is close (e.g., time difference within a few cycles) to the video signals B, C, changing to the specific color may be cancelled. This enables the moving object to be shown by using a display color meeting the actual moving object color. The moving object can be more noticeable.

Furthermore, in the above embodiment, a pixel is determined to be a moving image by the comparison unit 140 and the color signal of that pixel is changed to the specific color. However, with respect to the specific color, a hue, a brightness, or a chroma saturation can be altered according to the attenuated brightness difference outputted from the addition unit 180. For instance, this enables the newest movement position of the moving object to be shown by using the most remarkable color, and further this enables the attenuated brightness difference being smaller to be shown by using less remarkable color.

Furthermore, in the above embodiment, the addition unit 130, the field memory 170, and the addition unit 180 can be optional to this embodiment, so they can be removed from the structure of the embodiment. In this case, the moving object path cannot be displayed; however, at least the movement display data indicating the newest movement position of the moving object can be displayed by using the brightness difference between each pixel of the newest video signal C and that of the video signal B one given cycle before the newest video signal C.

Furthermore, each component or unit included in the control unit 100 can be achieved by program in the microcomputer or by a hardware circuit.

It will be obvious to those skilled in the art that various changes may be made in the above-described embodiments of the present invention. However, the scope of the present invention should be determined by the following claims.

What is claimed is:

1. A liquid crystal display device that obtains with a given cycle a video signal that changes on a basis of time and displays video based on the obtained video signal, the liquid crystal display device comprising:

a displaying unit including a liquid crystal panel;

a storing unit configured to store the video signal;

a temperature detecting unit configured to detect a temperature of the displaying unit;

a determining unit configured to distinguish, with respect to the video signal, between (i) a moving image portion indicating a moving object that moves not less than a given movement amount and (ii) a still image portion other than the moving image portion;

a warning unit configured, in case that the determining unit detects the moving image portion indicating the moving object that moves not less than the given movement amount when the temperature detecting unit detects a temperature less than a predetermined temperature, and to notify using a message indicating that the moving image portion is processed based on the stored video signal and displayed in the liquid crystal panel of the displaying unit; and a generating unit configured, in case that the determining unit detects the moving image portion indicating the moving object that moves not less than the given movement amount when the temperature detecting unit detects the temperature less than the predetermined temperature to generate, with respect to the moving image portion, (i) movement display data that indicates a movement position of the moving image portion based on a new video signal, which is obtained after a previous video signal; and (ii) video display data indicating the moving image portion to be displayed by the displaying unit, the video display data being generated by moving, according to the generated movement display data indicating the movement position, the moving image portion based on the previous video signal, and the displaying unit being further configured to display the moving image portion by using the video display data, which is generated based on the previous video signal by the generating unit, without using the new image signal.

2. The liquid crystal display device of claim 1, further comprising:

a repetition times setting unit configured to set, based on the detected temperature of the displaying unit, repetition times that, as a same video signal, previous video data is repeatedly used with respect to the moving image portion, the generating unit being further configured to generate, with respect to the moving image portion, the video display data with the given cycle by repeatedly using the same video signal by the set repetition times.

3. The liquid crystal display device of claim 2, the generating unit being further configured to extract the moving image portion from the same video signal repeatedly used and the still image portion from a newest video signal obtained most recently, and to combine the extracted moving image portion with the extracted still image portion to generate the video display image.

4. The liquid crystal display device of claim 2, the warning unit further configured to indicate a warning that the generating unit is repeatedly using the same video signal for displaying the moving image portion.

5. The liquid crystal display device of claim 4, wherein:

the warning unit generates the warning as image data and provides the generated warning to the generating unit, and the generating unit generates video display data including the warning.

6. The liquid crystal display device of claim 2, the determining unit being further configured to determine, as the moving image portion, a region of pixels where a given brightness difference between a brightness of each pixel of a newest video signal obtained most recently and a brightness of each pixel of a video signal obtained one given cycle before the newest video image is not less than a given threshold value.

7. The liquid crystal display device of claim 6, further comprising:

a brightness difference storing unit for storing the given brightness difference, wherein:

the determining unit computes (i) an attenuated brightness difference by multiplying the stored given brightness difference by an attenuation coefficient and (ii) an added brightness difference by adding the attenuated brightness difference to the given brightness difference, and determines the moving image portion based on the added brightness difference substituted for the given brightness difference; and the generating unit generates the movement display data based on the determined moving image portion.

8. The liquid crystal display device of claim 7, wherein the movement display data is generated so that display forms are changed based on the attenuated brightness difference.

9. The liquid crystal display device of claim 8, wherein the movement display data is generated so that display colors are changed based on the attenuated brightness difference.

10. The liquid crystal display device of claim 2, wherein the generating unit being further configured to generate path display data that indicates a movement path of the moving image portion based on a video signal that was previously used for displaying the moving image portion, and generates video display data with which the generated path display data is also combined.

* * * * *